US005184097A

United States Patent [19]

Brouzes et al.

[11] Patent Number: 5,184,097

[45] Date of Patent: Feb. 2, 1993

[54] AGILE MICROWAVE FILTER HAVING AT LEAST ONE FERRITE RESONATOR

[75] Inventors: Carole Brouzes, Asnieres; Claude Ressencourt, Acquigny; Alain de Place, Paris, all of France

[73] Assignee: Alcatel Transmission par Faisceaux Hertziens, Levallois Perret Cedex, France

[21] Appl. No.: 655,604

[22] Filed: Feb. 15, 1991

[30] Foreign Application Priority Data

Feb. 23, 1990 [FR] France ..... 90 02280

[51] Int. Cl.[5] ..... H01P 1/219

[52] U.S. Cl. ..... 333/202; 333/209; 333/210; 333/219.2

[58] Field of Search ..... 333/202, 208-212, 333/219, 219.2, 1.1, 235

[56] References Cited

U.S. PATENT DOCUMENTS

| | | | |
|---|---|---|---|
| 2,948,868 | 8/1960 | Reeves | 333/209 X |
| 3,001,154 | 9/1961 | Reggia | 333/209 |
| 3,593,210 | 7/1971 | Skedd | 333/209 |
| 3,919,673 | 11/1975 | Kostelnick | 333/24.2 |
| 4,122,418 | 10/1978 | Nagao | 333/1.1 X |
| 4,143,344 | 3/1979 | Nishikawa et al. | 333/202 |
| 4,578,655 | 3/1986 | Etienne et al. | 333/210 X |
| 5,032,811 | 7/1991 | Nishikawa et al. | 333/219.2 |

FOREIGN PATENT DOCUMENTS

| | | | |
|---|---|---|---|
| 2521786 | 8/1983 | France . | |
| 2610766 | 8/1988 | France | 333/202 |
| 0201503 | 9/1986 | Japan | 333/219.2 |
| 0076301 | 4/1987 | Japan | 333/219.2 |
| 1319117 | 6/1987 | U.S.S.R. | 333/208 |
| 1385164 | 3/1988 | U.S.S.R. | 333/202 |
| 1340162 | 12/1973 | United Kingdom . | |

OTHER PUBLICATIONS

Patent Abstracts of Japan, vol. 11, No. 70 (E-485)(2517) Mar. 3, 1987, and JP-A-61 225903 (Fujitsu Ltd) Oct. 7, 1986.

IEEE Transactions on Microwave Theory and Techniques, vol. 29, No. 8, Aug. 1981, New York, USA, pp. 754-770; J. K. Plourde et al.: "Application of dielectric resonators in microwave components".

*Primary Examiner*—Paul M. Dzierzynski
*Assistant Examiner*—Seung Ham
*Attorney, Agent, or Firm*—Sughrue, Mion, Zinn, Macpeak & Seas

[57] ABSTRACT

An agile microwave filter tunable by ferrite is constituted as a filter having dielectric confinement resonators and as a result comprises an evanescent mode waveguide and resonant cylinders placed in the waveguide. In addition, the cylinders are made of ferrite and means are provided for applying an adjustable magnetic field thereto, thereby enabling the center frequency of the filter to be shifted.

2 Claims, 2 Drawing Sheets

AGILE MICROWAVE FILTER HAVING AT LEAST ONE FERRITE RESONATOR

The present invention relates to an agile microwave filter, and in particular to a filter of this type suitable for use both in transmission and in reception for implementing frequency-agile radio beams.

BACKGROUND OF THE INVENTION

An agile filter is a filter whose center frequency can be voluntary shifted by electrical or electronic control means over a range of frequencies that may cover a large fraction of an octave. In association with frequency synthesizers, such filters are essential components for implementing agile radio beams as are widely used, in particular, in applications where it is desirable to be able to change the transmission frequency of a signal very quickly.

Such agile filters must not only be capable of changing center frequency very quickly, they must also be capable of withstanding varying power levels:

when used for transmission, they operate under high power (at the output from transmission amplifiers) and their function is to prevent the transmitter polluting adjacent channels;

when used as channel filters on reception, they enable the receiver to amplify only the wanted signal and to exclude pollution from adjacent transmissions; although they are then theoretically operating at low power, they must nevertheless avoid being damaged or destroyed by said adjacent transmissions which may apply disturbing signals thereto at power levels that are much higher than those of normally-received signals.

Numerous types of agile microwave filter are already in use or are described in the literature.

The most conventional agile filter is a filter having resonant cavities that are tuned mechanically under motor control. This type of filter can withstand high powers, but it is no longer suitable for present-day applications since its operating time to change frequency is extremely long, e.g. of the order of one minute, whereas certain projected applications require a channel switching time of much less than one second, and more specifically of the order of a millisecond. In addition, they suffer from other drawbacks of being bulky, relatively heavy, and particularly expensive and complex to manufacture because of the difficult and accurate mechanical constraints that must be satisfied.

A resonant cavity may also be tuned by using variable capacitance diodes or "varactors" which react in a very short period of time, typically of the order of a microsecond. Unfortunately such filters cannot be used with radio beams because the power they can accept is much too low (less than 0 dBm), and in addition their operating frequency is limited with presently available components to frequencies below 2 GHz.

Such tuning may also be obtained quickly by the action of a polarizing magnetic field on a resonator having yttrium iron garnet (YIG) beads. Nevertheless, the power performance of such a resonator is much too low, being of about the same order of magnitude as for the above-mentioned varactor filters.

Patent Document FR-A-2 521 786, which refers to Document FR-A-2 509 537 describes a bandpass filter having dielectric resonators placed in a waveguide having a cross-section whose dimensions are about 2.5 times the transverse dimensions of the resonators. A YIG pellet is placed on each of the dielectric resonators so as to make the filter magnetically tuneable under the action of adjustable external magnetic fields. The air-gap in the magnetic circuits for creating these magnetic fields is then very large such that in order to obtain a satisfactory tuning range the number of ampere-turns required is very large and current consumption is therefore very high. In addition, making such composite resonators is relatively expensive, specifically because of their composite nature.

Finally, Document FR-A-2 610 766 in the name of the present applicant describes a power resonator constituted at least in part by polycrystalline ferrite and in which tuning is changed very quickly by applying an adjustable magnetic field. The technique disclosed in that document is based on using a resonant coaxial line made from a cylindrical bar of metal-plated polycrystalline ferrite. This ferrite resonator is placed in a device suitable for generating a variable magnetic field. The field thus causes the magnetic permeability of the ferrite material to vary in such a manner as to vary the electrical length of the coaxial line, thereby varying the frequency of the resonator.

However, the above technique does not enable high unloaded Q-factors to be obtained as are essential for making the very narrow band microwave filters required by present radio beams. The unloaded Q-factor of the structure described in said Document FR-A-2 610 766 is limited by the metallic confinement of the microwave electromagnetic fields of the coaxial cavity, and this limitation is made worse by the dielectric permittivity of the material reducing the dimensions of the resonant cavity compared with a corresponding cavity filled with air, and also by the appearance of interfering parasitic modes which would be the consequence of enlarging the structure for the purpose of increasing its unloaded Q-factor.

The invention seeks to remedy these various drawbacks.

SUMMARY OF THE INVENTION

To this end, the present invention provides an agile microwave filter whose structure is similar to that of filters having dielectric resonator(s) placed, for example, in a waveguide operating below cutoff, but in which the dielectric confinement resonator(s) is/are replaced by similar resonators made of ferrite material and not of a material which is purely dielectric, means also being provided to apply a magnetic field of adjustable intensity to said ferrite resonator(s), thereby displacing the center frequency of the filter.

BRIEF DESCRIPTION OF THE DRAWINGS

Embodiments of the invention are described by way of example with reference to the accompanying drawings, in which.

DETAILED DESCRIPTION

Figure 1:
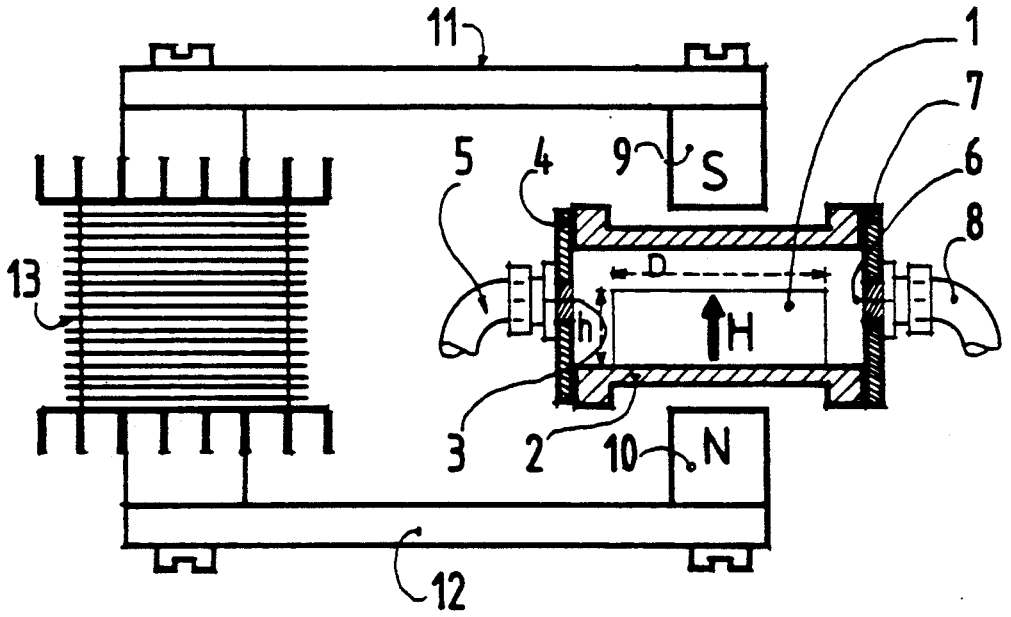
FIG. 1 shows a first embodiment of the agile filter.

With reference to FIG. 1, the agile microwave frequency comprises a ferrite cylinder 1 of diameter D and height h which is placed as in prior art dielectric resonator filters on the bottom of a portion 2 of rectangular section waveguide operating in evanescent mode, i.e. beneath cutoff.

More precisely, the ferrite bar 1 operates in $TM_{01\delta}$ mode whereas the evanescent mode waveguide 2 is excited in $TM_{11}$ mode by a coaxial antenna 3 placed at the inlet of the filter and passing conventionally through a first metal end plate 4. The input microwave signal is conveyed to the antenna 3 by a signal feed coaxial cable 5.

Completely symmetrically, the output signal from the filter is taken from the other end of the waveguide 2 by a coaxial antenna 6 which similarly passes through a second metal end plate 7, with said antenna 6 conventionally extending the core of the outlet coaxial cable 8 (in the same way as the antenna 3 extends the core of the feed coaxial cable 5).

Not only does the ferrite bar 1 have the property of high magnetic permeability, it also has the property (which is mistakenly little known at present) of quite high dielectric permittivity, since its relative permittivity is about 15, whereas that of the materials used in conventional dielectric reasonators is about 40. As a result, in contrast to what could have been thought a priori in this case, the bar 1 achieves dielectric confinement which causes it to act as a resonator without there being any need to coat it with two concentric metal layers as described in Document FR-A-2 610 766.

The resonant frequency of the ferrite bar 1 depends on the product of its dielectric permittivity multiplied by its magnetic permeability, thereby making it possible to vary the resonant frequency of the bar 1 and thus to vary the center frequency to which the filter of FIG. 1 is tuned by causing said magnetic permeability to vary which can be done with ferrite material by applying a polarizing magnetic field thereto of adjustable intensity, as described in above-mentioned Document FR-A-2 610 766.

To this end, the ferrite bar 1 is also placed in a magnetic field H which is established coaxially with the bar 1 between the two pole pieces 9 and 10 of an electromagnet 11 comprising a soft-iron magnetic circuit 12 and an excitation winding 13 conveying an adjustable direct current. By varying the excitation current flowing through the winding 13, the value of the field H is varied, thereby varying the resonant frequency of the bar 1 and thus shifting the center frequency of the filter.

It should be observed that the magnetic conduction property of the bar 1 in conjunction with its non-negligible height h means that the air gap in the magnetic circuit 12 is relatively small, thus enabling the field H to be varied and consequently enabling the center frequency of the filter to be shifted over a wide range without requiring the windings 13 to consume excessive amounts of current.

For example, such an agile microwave filter has been made using a garnet type polycrystalline ferrite material whose effective spectrum line width is very small, thereby making it possible to achieve a large Q-factor (greater than 2,000).

The dimensions of the resonant cylinder 1 were as follows:

diameter D: 5.8 mm height h: 4.2 mm with the evanescent mode rectangular waveguide 1 having the following inside dimensions:

short dimension: 4.9 mm long dimension: 10.7 mm

Figure 2:
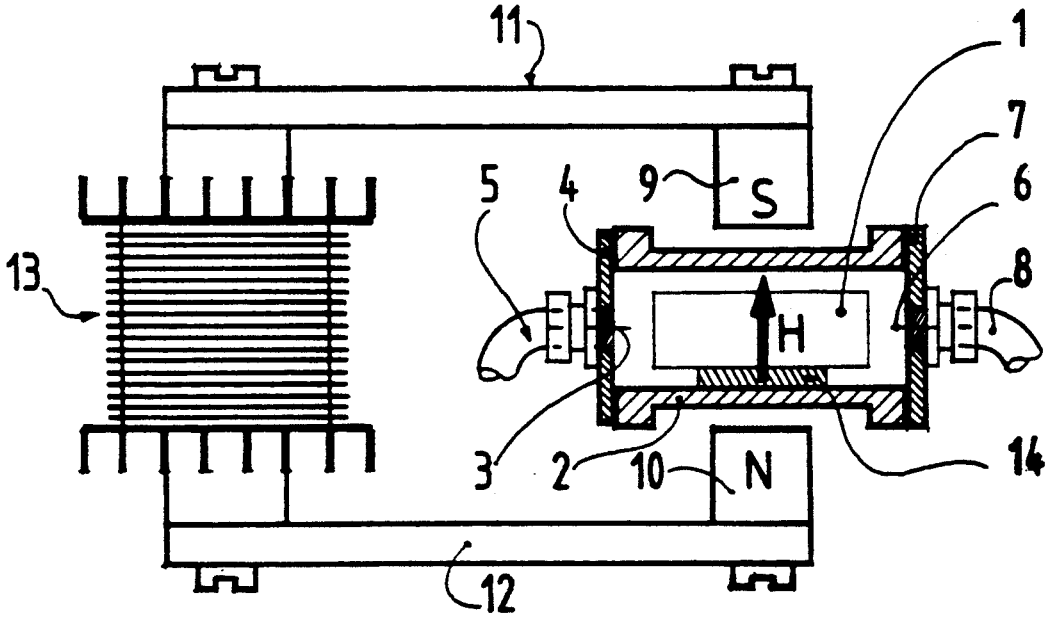
FIG. 2 shows a variant of the FIG. 1 filter.

Instead of placing the ferrite cylinder 1 on the bottom of the waveguide 2, it is also possible to place it as shown in FIG. 2 on a thin wafer 14 of low permitivity dielectric material which is in turn placed on the bottom of the waveguide 2, thus making it possible under some circumstances to avoid disturbances.

By acting on the excitation of the windings 13, the center frequency of the microwave filter of FIGS. 1 or 2 could be shifted continuously between 14.450 GHz and 15.447 GHz without the windings consuming excessive current.

Figure 3:
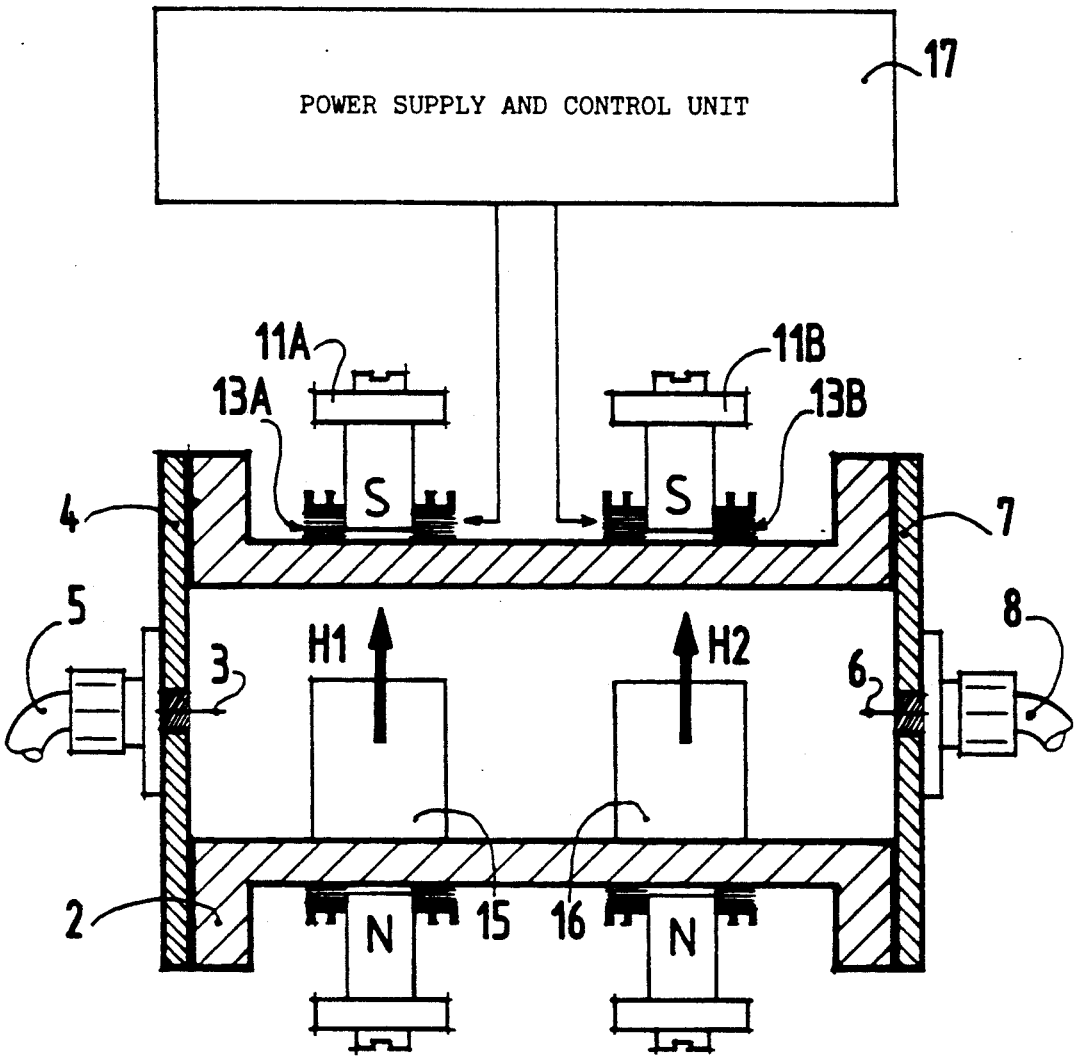
FIG. 3 shows an embodiment of a passband filter including a plurality of resonant elements.

Finally, FIG. 3 shows an agile bandpass filter made by associating two ferrite resonators 15 and 16 in the same waveguide 2, the resonators each operating as a dielectric confinement resonator, and with the filter being basically similar to conventional bandpass filters using dielectric resonators (see FIG. 1 of above-mentioned Document FR-A-2 590 537, for example) except that in this case the coupled resonators 15 and 16 are made of ferrite and, in addition, they are subjected to respective adjustable magnetic fields H1 and H2 created by electromagnets 11A and 11B, like the single resonator 1 in FIGS. 1 and 2.

As shown diagrammatically in the drawing, the windings 13A and 13B of the electromagnets 11A and 11B are excited with respective adjustable excitation currents by a power supply and control unit 17.

Naturally, the invention is not limited to the embodiments described above. Thus, for example, the relative dimensions of the resonators and of the waveguide could be different. Other coupling modes could be used between the inlet and the outlet, for example using irises, in which case the waveguide used could operate in a mode other than evanescent mode, etc. . . . Naturally, without going beyond the scope of the invention, the magnetic circuits of the electromagnets could include permanent magnets contributing to creating the magnetic field.

We claim:

1. An agile microwave filter comprising: a waveguide, at least one dielectric confinement resonator operating in TM mode, made of ferrite material and placed on the bottom of said waveguide, said waveguide operating in evanescent mode, and means for applying a magnetic field of adjustable intensity to said at least one ferrite resonator for shifting the center frequency of the filter.

2. An agile microwave filter comprising: a waveguide, at least one dielectric confinement resonator operating in a TM mode, made of ferrite material and a thin dielectric wafer placed between said at least one resonator and said waveguide for fixing said resonator of ferrite material to the bottom of said waveguide and acting as a pedestal for said resonator.

* * * * *